US006491545B1

(12) United States Patent
Spiegel et al.

(10) Patent No.: US 6,491,545 B1
(45) Date of Patent: Dec. 10, 2002

(54) MODULAR SHIELDED COAXIAL CABLE CONNECTOR

(75) Inventors: Marko Spiegel, LaFox, IL (US); David E. Dunham, Aurora, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/565,705

(22) Filed: May 5, 2000

(51) Int. Cl.[7] ..... H01R 9/05
(52) U.S. Cl. ..... 439/579; 439/608; 439/931
(58) Field of Search ..... 439/578–585, 439/701, 717, 79, 720, 723–724, 608, 607, 63, 931, 497

(56) References Cited

U.S. PATENT DOCUMENTS

| | | | | |
|---|---|---|---|---|
| 4,969,827 A | | 11/1990 | Hahs, Jr. | 439/68 |
| 5,066,236 A | | 11/1991 | Broeksteeg | 439/79 |
| 5,167,531 A | | 12/1992 | Broschard, III et al. | 439/540 |
| 5,173,056 A | | 12/1992 | Kniese et al. | 439/79 |
| 5,281,762 A | * | 1/1994 | Long et al. | 439/579 |
| 5,354,219 A | * | 10/1994 | Wanjura | 439/608 |
| 5,387,114 A | | 2/1995 | Brunker et al. | 439/108 |
| 5,439,385 A | | 8/1995 | Sakai et al. | 439/79 |
| 5,522,727 A | | 6/1996 | Saito et al. | 439/65 |
| 5,674,077 A | | 10/1997 | Flaig et al. | 439/63 |
| 5,842,872 A | * | 12/1998 | Hosler, Sr. et al. | 439/579 |
| 5,943,770 A | * | 8/1999 | Thenaisie et al. | 29/883 |
| 5,980,321 A | * | 11/1999 | Cohen et al. | 439/608 |
| 5,997,358 A | | 12/1999 | Adriaenssens et al. | 439/676 |

FOREIGN PATENT DOCUMENTS

| | | | |
|---|---|---|---|
| EP | 0 852 414 A2 | 7/1998 | H01R/23/68 |

* cited by examiner

*Primary Examiner*—Renee Luebke
*Assistant Examiner*—Phuong Nguyen
(74) *Attorney, Agent, or Firm*—Robert J. Zeitler

(57) ABSTRACT

A modular shielded coaxial cable connector includes at least a pair of dielectric housing modules defining at least one cable-receiving passage therebetween. The passage is split axially whereby a passage portion is disposed in each housing module. The housing modules are plated with conductive shielding material at least in the area of the split passage. A coaxial cable section is disposed in the cable-receiving passage. The cable section includes a conductive core surrounded by a dielectric sheath.

20 Claims, 3 Drawing Sheets

MODULAR SHIELDED COAXIAL CABLE CONNECTOR

FIELD OF THE INVENTION

This invention generally relates to the art of electrical connectors and, particularly, to a modular shielded coaxial cable connector which uses shielded dielectric housing modules.

BACKGROUND OF THE INVENTION

A typical coaxial cable includes a center core conductor surrounded by a tubular-like dielectric sheath which, in turn, is surrounded by a shield which typically is a cylindrical metallic braid. A dielectric cover may surround the braid. The braid is used for both shielding and grounding purposes.

A wide variety of connectors are available for terminating and/or interconnecting coaxial cables. Such a connector typically includes some form of dielectric housing having at least one through passage for receiving a coaxial cable. At least portions of the housing are covered by a conductive shielding member, and appropriate mounting means are provided for securing the shielding member to the housing. The coaxial cable typically is "stripped" to expose the shielding braid thereof. The braid is somehow coupled to the shield of the connector. For instance, the braid may be soldered to the connector shield, and/or the braid may be soldered to a separate grounding member of the connector. With the ever-increasing miniaturization and high density of contemporary electrical circuitry, coaxial cables have become quite difficult to manufacture and use due to the complexity of the connectors. The present invention solves these problems by providing a modular shielded coaxial cable connector using a split housing of dielectric modules plated with a conductive shielding material.

SUMMARY OF THE INVENTION

An object, therefore, of the invention is to provide a new and improved modular shielded coaxial cable connector.

In the exemplary embodiment of the invention, the connector includes at least a pair of dielectric housing modules defining at least one cable-receiving passage therebetween. The passage is split axially whereby a passage portion is disposed in each housing module. The housing modules are plated with conductive shielding material at least in the area of the split passage. A coaxial cable section is disposed in the cable-receiving passage. The cable section includes a conductive core surrounded by a dielectric sheath.

As disclosed herein, a plurality of the split cable-receiving passages are provided between the housing modules. The passages are substantially equally spaced. Each passage is split generally along a centerline thereof, whereby a passage-half is disposed in each housing module.

In one embodiment of the invention, the split cable-receiving passages extend at angles (e.g., right angled passages). The passages are coplanar, and the passages are split in a plane coextensive with their respective angle. In another embodiment of the invention, each split cable-receiving passage extends at an angle and the passage is split in a direction generally perpendicular to the plane of the angle.

The invention contemplates that a plurality (more than two) dielectric housing modules can be provided in a stacked arrangement. Each pair of adjacent housing modules has at least one of the split cable-receiving passages therebetween.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
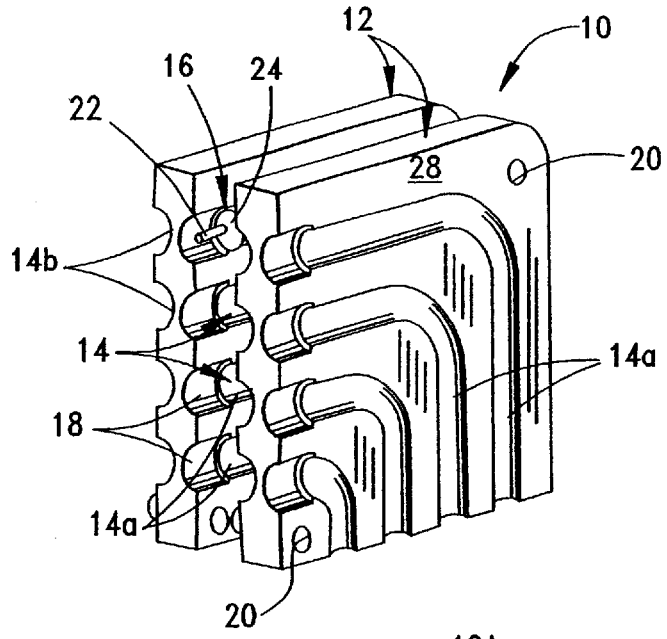
FIG. 1 is perspective view of one embodiment of a modular shielded coaxial cable connector incorporating the concepts of the invention.

Referring to the drawings in greater detail, and first to FIG. 1, a first embodiment of a modular shielded coaxial cable connector, generally designated 10, is shown according to the invention. The connector includes at least a pair of plated housing modules, generally designated 12, defining a plurality of cable-receiving passages, generally designated 14, therebetween. A coaxial cable section, generally designated 16, is disposed in one or more or all of passages 14. Only one coaxial cable section is shown to avoid cluttering the illustration. Enlarged receptacle areas 18 are provided at one or both of the ends of each passage 14.

Figure 9:
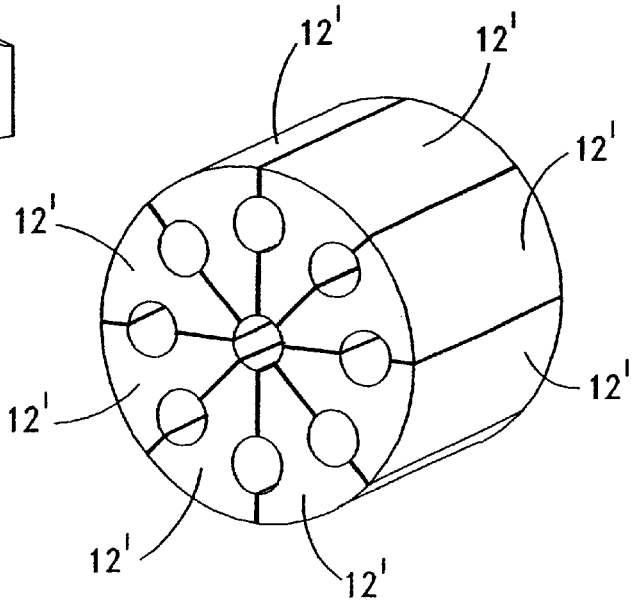
FIG. 9 is a perspective view of an alternative embodiment (circular) of a modular shielded cable connector.

More particularly, each cable-receiving passage 14 is split axially whereby a passage portion 14*a* is disposed in each housing module 12 for each passage. Preferably, the passages are split generally along centerlines thereof, whereby passage portions 14 comprise passage-halves which combine to form the whole passages. In addition, the modular shielded coaxial connector may be circular, as illustrated in FIG. 9, with each of the housing modules 12' being generally pie-shaped. FIG. 1 shows housing modules 12 separated to better illustrate the opposing passage-halves and the one coaxial cable section 16. In full assembly, the housing halves are juxtaposed into abutment and held together either by appropriate adhesives or fasteners extending through assembly holes 20.

Each coaxial cable section 16 includes a center conductive core 22 surrounded by a dielectric tubular-like sheath 24. The sheath is stripped as shown in FIG. 1, so that a length of core 22 projects into receptacle area 18 of the respective passage 14. An appropriate female connector (not shown) can be inserted into receptacle area 18.

The invention contemplates that each housing module 12 be molded in its desired configuration. As shown in the embodiment of FIG. 1, the housing modules are generally rectangular (square) thin block-like members. Passage halves 14*a* are molded directly into the opposite faces of the housing modules. The modules can be molded of appropriate dielectric material such as plastic or the like. The entire molded plastic housing modules then are substantially entirely plated with a conductive shielding material. The modules can be plated with a conductive metal in a wet chemical electroless process.

Of course, the invention is not limited to the particular configuration of the housing modules shown in FIG. 1 and a wide variety of configurations are readily apparent. In addition, the invention is not limited to entirely plating the modules, and plating in at least the areas of split passages 14 is contemplated. With the thin modules shown in FIG. 1, and with passage halves 14*a* being molded on both opposite faces of the modules, plating each entire module has been found to be quite efficient.

In the embodiment of FIG. 1, it can be seen quite clearly that cable-receiving passages 14 formed by passage-halves 14*a* are generally coplanar and extend at angles through housing modules 12. Precisely, the passages and passage-halves extend at right-angles and open at adjacent edges of the modules. Therefore, in this embodiment, the passages are split in a plane coextensive with the angle of the passages. In other words, all of the passages between any two adjacent housing modules 12 are in a common plane.

Figure 2:
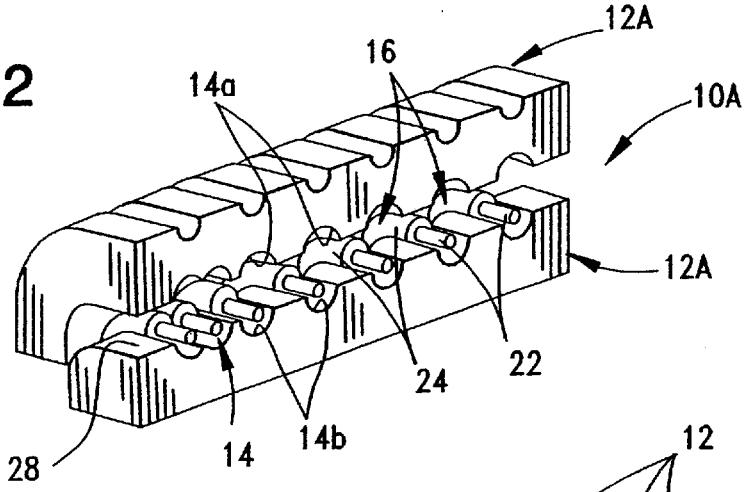
FIG. 2 is a perspective view of another embodiment of the invention.

FIG. 2 shows an alternative embodiment of a connector 10A wherein the cable-receiving passages extend between a pair of housing modules 12A at right-angles. However, the passages in connector 10A are split in a direction generally perpendicular to the planes of the angles of the coaxial cables. Other than the configuration of housing modules 12A as seen in FIG. 2, the housing modules are fabricated the same and like reference numerals have been applied in FIG. 2 corresponding to like components described above in relation to the embodiment of FIG. 1.

Figure 3:
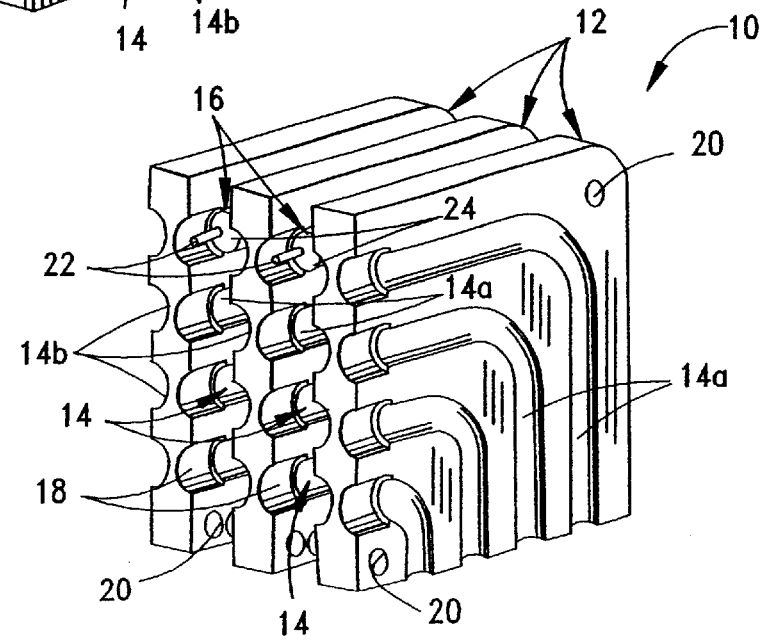
FIG. 3 is a perspective view of the embodiment of FIG. 1, showing that the housing modules can be stacked in considerable multiples.
Figure 4:
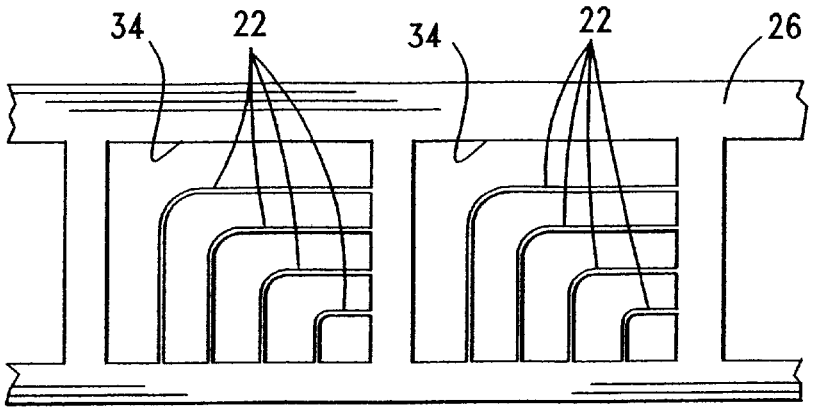
FIG. 4 shows a first step in fabricating one of the housing modules of the embodiment shown in FIGS. 1 and 3, namely stamping the center conductor cores of the coaxial cable sections.

FIG. 3 simply shows the embodiment of FIG. 1 with a third housing module 12 added. This depiction emphasizes that any number of housing modules 12 can be stacked in high density array of coaxial cables 16, with cable-receiving passages 14 formed by passage-halves 14*a* being disposed between each adjacent pair of modules in the stacked array thereof.

Figure 8:
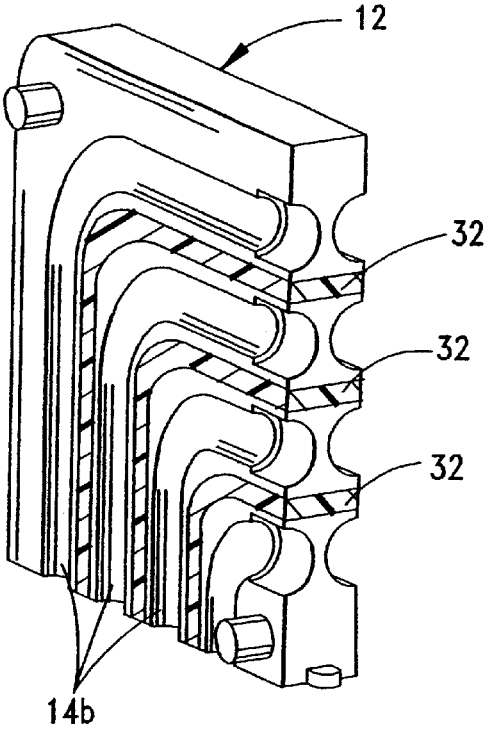
FIG. 8 is a perspective view of the embodiment of FIG. 1, showing electrical isolation between the cable-receiving passages.

In the embodiment shown in FIG. 8, it can be seen that electrical isolation 32 exists between the passage halves 14*a* to provide electrical isolation between the cable-receiving passages. The electrical isolation 32 may take the form of selective non-plating of the housing module 12, although this invention is not limited to only that method of providing electrical isolation between the cable-receiving passages.

FIGS. 4–7 show the steps in fabricating coaxial cable connector 10 to exemplify the simplicity of the connector as well as the ease in manufacturing and assembling the connector. More particularly, referring first to FIG 4, a sheet 26 of conductive metal material is provided, and conductors 22 are stamped out of openings 34 in a plurality of groupings lengthwise of the sheet which is provided in strip-like form for feeding through an appropriate stamping machine.

Figure 5:
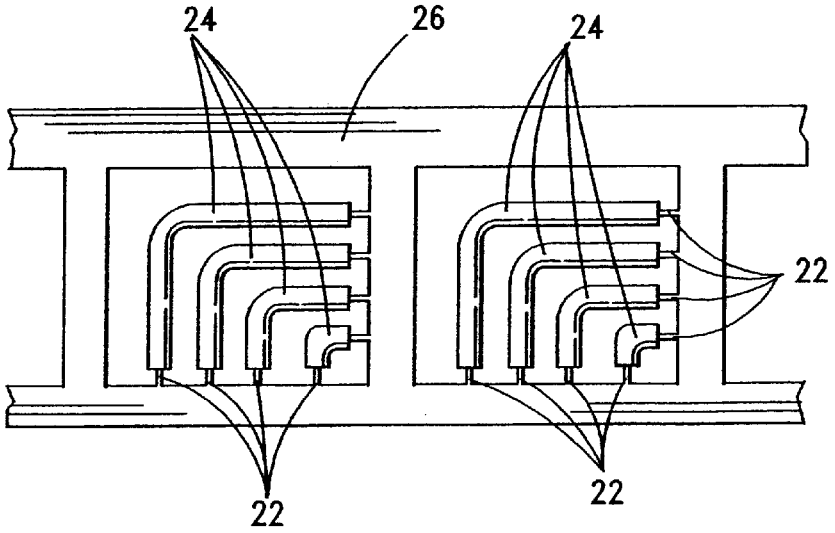
FIG. 5 is a view similar to that of FIG. 4, but showing the conductor cores overmolded with dielectric sheaths.

FIG. 5 shows the next step of overmolding dielectric sheaths 24 about conductive cores 22. This can be easily accomplished by placing stamped sheet 26 (FIG. 4) into an appropriate molding die and overmolding the dielectric sheaths about the conductive cores, as shown.

In a separate operation, housing modules 12 (FIG. 6) are molded as plastic blocks including passage halves 14*a* molded in opposite faces of the blocks, and the plastic blocks then are plated with a conductive shielding material 28, particularly in the area of the passage halves. These molded, plated housing modules can be maintained in inventory and used as needed.

Figure 7:
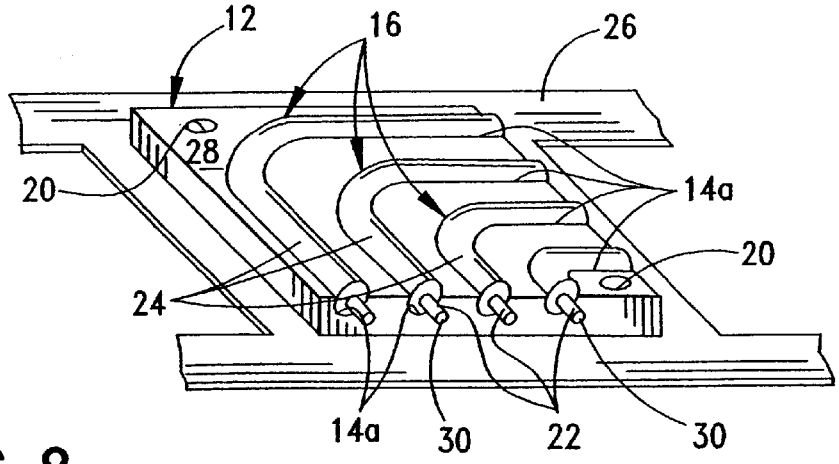
FIG. 7 is a perspective view showing how the coaxial cable sections of FIG. 5 are laid into the housing module of FIG. 6.

FIG. 7 shows the next step in fabricating the coaxial cable connector and includes taking the subassembly of FIG. 5 and laying the subassembly onto one or more of the molded and plated housing modules 12. The subassemblies of FIG. 5 may be fabricated in a continuous fashion so that the subassemblies can be wound onto a reel. The subassemblies then can be fed to an indexing machine where they are sequentially laid onto housing modules 12 as the modules are fed seriatim to an assembly station. Conductive cores 22 are severed from sheet 26, as at 30, either at the point of assembly to the housing modules or thereafter in the assembly line. Holes 20 also can be punched through the housing module at the same time that the cores are severed from the metallic sheet.

Figure 6:
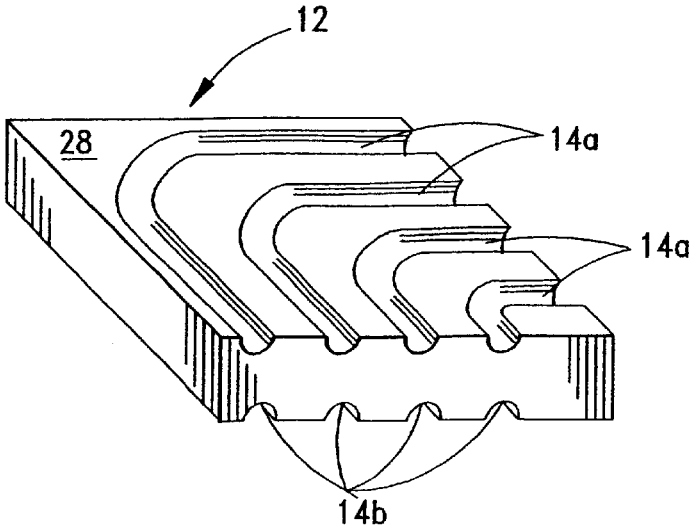
FIG. 6 is a perspective view of one of the plated housing modules.

After the assembly of FIG. 7, various options are available. For instance, a second housing module 12 can be immediately adhered to or fastened to the assembly shown in FIG. 7 to form a connector as shown at 10 in FIG. 1. In the alternative, coaxial cable sections 16 (FIG. 7) can be adhered within passage halves 14*a* and a plurality of these assemblies can be stacked, as desired, in a high density array until a housing module such as shown in FIG. 6 is used as an "end cap" at the end of the stacked array.

It will be understood that the invention may be embodied in other specific forms without departing from the spirit or central characteristics thereof The present examples and embodiments, therefore, are to be considered in all respects as illustrative and not restrictive, and the invention is not to be limited to the details given herein.

What is claimed is:

1. A modular shielded coaxial cable connector, comprising:

at least a pair of dielectric housing modules defining at least one cable-receiving passage therebetween, the passage being split axially whereby a passage portion is disposed in each housing module, and the housing modules being plated with conductive shielding material at least in an area of the split passage; and a coaxial cable section disposed in the cable-receiving passage, the cable section including a conductive core surrounded by a dielectric sheath.

2. The modular shielded coaxial cable of claim 1 wherein said cable-receiving passage is split generally along a centerline thereof, whereby a passage-half is disposed in each housing module.

3. The modular shielded coaxial cable of claim 1 wherein said dielectric housing modules are substantially entirely plated with said conductive shielding material.

4. The modular shielded coaxial cable of claim 1 wherein at least one of said housing modules has said passage portion on one side thereof and includes a passage portion on an opposite side thereof for cooperation with a third housing module to form a stacked connector.

5. The modular shielded coaxial cable of claim 1, including a plurality of said split cable-receiving passages between the housing modules.

6. The modular shielded coaxial cable of claim 5 wherein said plurality of split cable-receiving passages are nonlinear and equally spaced.

7. The modular shielded coaxial cable of claim 1 wherein said split cable-receiving passage extends at an angle and the passage is split in a plane coextensive with the angle.

8. The modular shielded coaxial cable of claim 7 wherein said cable-receiving passage is split generally along a centerline thereof, whereby a passage-half is disposed in each housing module.

9. The modular shielded coaxial cable of claim 1 wherein said split cable-receiving passage extends at an angle and the passage is split in a direction generally perpendicular to the plane of the angle.

10. The modular shielded coaxial cable of claim 9 wherein said cable-receiving passage is split generally along a centerline thereof, whereby a passage-half is disposed in each housing module.

11. A modular shielded coaxial cable connector, comprising:

at least a pair of dielectric housing modules defining a plurality of generally equally spaced cable-receiving passages therebetween, each passage being split generally along a centerline thereof whereby a passage-half is disposed in each housing module, and the housing modules being plated with conductive shielding material at least in areas of the split passages; and a coaxial cable section disposed in at least some of the cable-receiving passages, each cable section including a conductive core surrounded by a dielectric sheath.

12. The modular shielded coaxial cable of claim 11 wherein each of said split cable-receiving passages extends at an angle and the passage is split in a plane coextensive with the angle.

13. The modular shielded coaxial cable of claim 11 wherein each of said split cable-receiving passages extends at an angle and the passage is split in a direction generally perpendicular to the plane of the angle.

14. The modular shielded coaxial cable of claim 11 wherein said dielectric housing modules are substantially entirely plated with said conductive shielding material.

15. A modular shielded coaxial cable connector, comprising:

a pality of stacked dielectric housing modules defining a plurality of adjacent pairs of modules, each pair of housing modules defining a plurality of cable-receiving passages therebetween, each passage being split axially whereby a passage portion is disposed in each housing module of each pair thereof, and the housing modules being plated with conductive shielding material at least in area of the split passages thereof; and a coaxial cable section disposed in at least some of the cable-receiving passages, each cable section including a conductive core surrounded by a dielectric sheath.

16. The modular shielded coaxial cable of claim 15 wherein each of said cable-receiving passages is split generally along a centerline thereof, whereby a passage-half is disposed in each housing module.

17. The modular shielded coaxial cable of claim 15 wherein said plurality of split cable-receiving passages are nonlinear and equally spaced.

18. The modular shielded coaxial cable of claim 15 wherein each of said split cable-receiving passages extends at an angle and the passage is split in a plane coextensive with the angle.

19. The modular shielded coaxial cable of claim 15 wherein said dielectric housing modules are substantially entirely plated with said conductive shielding material.

20. A modular shielded connector housing, comprising:

at least a pair of dielectric housing modules defining at least one cable-receiving passage therebetween, the passage being split axially whereby a passage portion is disposed in each housing module, and the housing modules being plated with conductive shielding material at least in a area of the split passage.

* * * * *